US009334551B2

(12) United States Patent
Trybus et al.

(10) Patent No.: US 9,334,551 B2
(45) Date of Patent: May 10, 2016

(54) NICKEL BERYLLIUM ALLOY COMPOSITIONS

(71) Applicants: Carole L. Trybus, Perrysburg, OH (US); John C. Kuli, Oak Harbor, OH (US); Fritz C. Grensing, Perrysburg, OH (US)

(72) Inventors: Carole L. Trybus, Perrysburg, OH (US); John C. Kuli, Oak Harbor, OH (US); Fritz C. Grensing, Perrysburg, OH (US)

(73) Assignee: Materion Corporation, Mayfield Heights, OH (US)

( * ) Notice: Subject to any disclaimer, the term of this patent is extended or adjusted under 35 U.S.C. 154(b) by 0 days.

(21) Appl. No.: 14/201,322

(22) Filed: Mar. 7, 2014

(65) Prior Publication Data

US 2014/0261910 A1 Sep. 18, 2014

Related U.S. Application Data

(60) Provisional application No. 61/793,421, filed on Mar. 15, 2013.

(51) Int. Cl.

| | |
|---|---|
| ***C22C 19/05*** | (2006.01) |
| ***C22C 19/00*** | (2006.01) |
| ***C22F 1/10*** | (2006.01) |
| ***C22C 19/03*** | (2006.01) |

(52) U.S. Cl.

CPC ..... *C22C 19/007* (2013.01); *C22C 19/03* (2013.01); *C22C 19/05* (2013.01); *C22C 19/058* (2013.01); *C22F 1/10* (2013.01); *Y10T 29/49988* (2015.01)

(58) Field of Classification Search

CPC .... C22C 19/007; C22C 19/05; C22C 19/057; C22F 1/10

See application file for complete search history.

(56) References Cited

U.S. PATENT DOCUMENTS

| | | | | |
|---|---|---|---|---|
| 3,343,949 A | | 9/1967 | Wikle | |
| 4,440,720 A | * | 4/1984 | Masumoto et al. | 420/459 |
| 4,556,534 A | | 12/1985 | Burnett et al. | |

FOREIGN PATENT DOCUMENTS

| | | | | |
|---|---|---|---|---|
| GB | 583845 A | | 1/1947 | |
| GB | 616614 | * | 8/1947 | C22C 19/007 |
| GB | 853103 | * | 11/1956 | C22C 19/007 |

OTHER PUBLICATIONS

International Search Report for PCT/US2014/022007 dated Jun. 23, 2014.

* cited by examiner

*Primary Examiner* — Jesse Roe

(74) *Attorney, Agent, or Firm* — Richard M. Klein; Fay Sharpe LLP

(57) ABSTRACT

Disclosed herein are nickel beryllium alloys having improved corrosion and hardness characteristics relative to known nickel beryllium alloys. The alloys have a chemical composition with about 1.5% to 5% beryllium (Be) by weight, about 0.5% to 7% niobium (Nb) by weight; and nickel (Ni). Up to about 5 wt % chromium (Cr) may also be included. The alloys display improved hardness and corrosion resistance properties.

20 Claims, 2 Drawing Sheets

NICKEL BERYLLIUM ALLOY COMPOSITIONS

CROSS-REFERENCE TO RELATED APPLICATIONS

This application claims priority to U.S. Provisional Patent Application Ser. No. 61/793,421, filed on Mar. 15, 2013, the contents of which are fully incorporated by reference herein.

BACKGROUND

The present disclosure relates to improved nickel beryllium alloy compositions. More particularly, the nickel beryllium alloy compositions of the instant application display improved corrosion resistance and galling resistance compared to existing nickel beryllium alloys.

Alloy 360™ is a known nickel-beryllium alloy provided by Materion Corporation (Cleveland, Ohio) that combines unique mechanical and physical properties required in high reliability elertrical/electronic systems, heavy duty controls, electromechanical devices and in other high performance applications. The chemical composition of Alloy 360™ includes about 1.85 wt % to 2.05 wt % beryllium and about 0.4 wt % to 0.6 wt % titanium, with the balance being nickel. A strip of nickel-beryllium Alloy 360™ has an ultimate tensile strength approaching about 300,000 psi, yield strength up to about 245,000 psi, flexible formability properties, stress relaxation less than about 5% at 400° F., and fatigue strength (in reverse bending) of about 85,000-90,000 psi at about 10 million cycles. Nickel-beryllium Alloy 360™ is used for mechanical and electrical/electronic components that are subjected to elevated temperatures (up to 700° F./350° C. for short times) and require good spring characteristics at these temperatures. Some applications for this alloy include thermostats, bellows, diaphragms, burn-in and test sockets. Nickel-beryllium Alloy 360™ is also used for high-reliability, corrosion resistant belleville washers in fire protection sprinkler heads among other things.

However, Alloy 360™ can be difficult to process due to discontinuous transformations in the alloy and a coarse microstructure in the as-cast and as-hot rolled form. In addition, the strength and hardness of the alloy is limited by its composition. It would be desirable to develop new alloy compositions with improved hardenability and processing capability relative to existing nickel-beryllium alloys.

BRIEF DESCRIPTION

The present disclosure relates to nickel-beryllium alloy compositions having improved corrosion and hardness characteristics relative to known nickel-beryllium alloys. The alloy compositions of the present disclosure comprise from about 0.4% to about 6% by weight niobium (Nb), and from about 1.5% to about 5% by weight beryllium (Be), with the remaining balance including nickel (Ni). The disclosed alloy composition further optionally includes from about 0% to about 5% by weight chromium (Cr).

In one embodiment, the disclosed nickel beryllium alloy composition includes about 2.0% to about 3.0% by weight beryllium (Be); from about 0.4% to about 6.0% by weight niobium (Nb); up to about 5% by weight of chromium (Cr); and up to about 0.7% by weight of titanium (Ti); with the remaining balance including nickel (Ni). Nickel is usually present in an amount of at least 88% by weight, or at least 93% by weight. These alloys display improved hardness and corrosion resistance properties.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
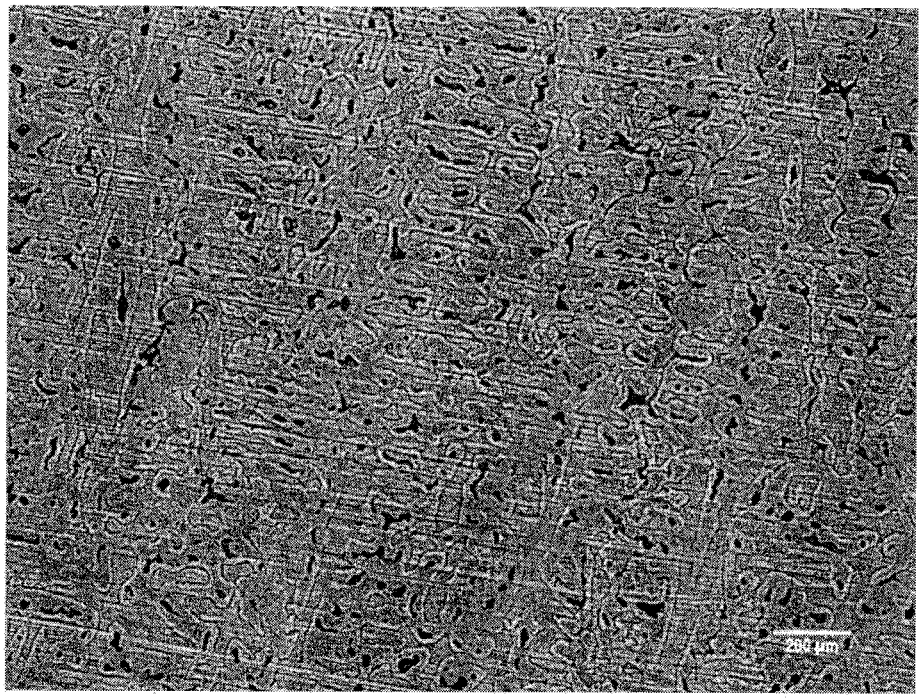
FIG. 1 is a photomicrograph that illustrates an as-cast micro-chemical structure of a known alloy formed from nickel and beryllium without the presence of niobium.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

Percentages of elements should be assumed to be percent by weight of the stated alloy, unless expressly stated otherwise.

The present disclosure relates to nickel-beryllium alloy compositions that have improved hardness characteristics while maintaining yield and tensile strength characteristics similar to those of the Alloy 360™ manufactured by Materion Corporation. The inventive alloy compositions may be considered to be an improved version of the Alloy 360™ nickel-beryllium alloy, and will also be referred to herein as "Alloy 360X".

The Alloy 360X compositions of the present disclosure comprise from about 1.5% to about 5.0% by weight (wt %) of beryllium (Be); and from about 0.4% to about 6.0% by weight of niobium (Nb), with the remaining balance being nickel (Ni). In particular embodiments, the alloy compositions include at least 88% by weight of nickel, or at least 93% by weight of nickel. In more specific embodiments, the alloy compositions comprise from about 2.0 wt % to about 3.0 wt % of Be; and from about 0.4 wt % to about 5.0 wt % of Nb.

The molar ratio of beryllium to niobium (i.e. Be:Nb) can be important. In embodiments, the molar Be:Nb ratio is from 4:1 to 70:1.

In other embodiments, the alloy compositions may also comprise up to about 5% by weight of chromium (Cr). More specifically, the alloy compositions may comprise from about 0.5 wt % to about 5 wt % of Cr. In this regard, amounts of 0.3 wt % Cr or below should be considered an unavoidable impurity.

In additional embodiments, the alloy compositions may also comprise up to about 0.7% by weight of titanium (Ti). In other alloy compositions, Ti may be considered an unavoidable impurity.

In more specific embodiments, the alloy comprises from about 2.2% to about 2.9% by weight of beryllium (Be); from about 0.4% to about 1.8% by weight of niobium (Nb); chromium (Cr) in an amount of up to about 5% by weight; titanium (Ti) in an amount of up to about 0.7% by weight; and at least 93% by weight of nickel (Ni).

The alloy compositions may contain unavoidable impurities of elements such as carbon (C), copper (Cu), aluminum (Al), iron (Fe), or titanium (Ti). For purposes of this disclosure, amounts of less than 0.3 wt % of these elements should be considered to be unavoidable impurities, i.e. their presence is not intended or desired.

It is believed that the presence of niobium changes the grain structure of articles formed from the alloy compositions of the present disclosure, making the grains finer. This permits the alloy to be hot worked more easily. In addition, this minimizes shear instability and strain localization, which are generally undesirable because they can cause cracking and reduce the hardness of articles formed from the alloys. With previous alloys, grain boundary precipitate could be seen, which appeared to be correlated with these undesirable properties. In this regard, the alloy compositions desirably have a Rockwell C hardness of at least 50, including at least 52. In contrast, the Alloy 360™ can achieve a maximum Rockwell C hardness (Rc) value of 45 in 4-inch-thick plates without cracking. Rc values of 50 have been obtained, but internal cracking occurs.

The Alloy 360X compositions of the present disclosure, containing nickel, beryllium, and niobium, are designed to have high corrosion resistance when tested under NACE MR0175/ISO 15156 at Level 4-5 while also achieving elevated hardness levels and anti-galling characteristics. As such, articles formed from the Alloy 360X compositions can be useful in various industrial and commercial applications such as within the oil and gas industry. In particular, the Alloy 360X compositions can be useful for making components used in blowout preventers or other similar oil and gas related apparatus, such as the knife blades or other support items.

The compositions can also be used as a replacement for known high performance steel and super alloys in applications requiring its combination of properties. The relatively simple chemistry of the Alloy 360X gives it an advantage over other alloys which are less chemically resistant and tend to gall. The Alloy 360X could also be used in the chemical processing industry as an alternative to other nickel alloys that have complex structures which are known to corrode.

Articles can be formed by casting the alloy using conventional static, semi-continuous, or continuous processes into a suitable slab or ingot form. The alloy is then hot worked at a temperature below 2100° F. Hot working includes various techniques such as mechanical shaping to change grain structure, working at a high temperature, extruding, forging, hot rolling, or pilgering. Next, the shaped article can be solution annealed. In solution annealing, the alloy is heated to a high temperature and held there for a period sufficient to permit impurities (e.g. carbon) to go into solution. The alloy is then quickly cooled to prevent the impurities from coming out of solution. Solution annealing can be performed at temperatures of 1900° F. to 2000° F., held at these temperatures for a period of 4 hours to 24 hours. The shaped article can be heat treated if desired, for example at a temperature of from about 1700° F. to about 2000° F. and a period of about 0.25 hours to about 4 hours. The article can also be aged if desired, for example at a temperature of 900° F.-1000° F. for a period of 4 hours to 16 hours.

The following examples are provided to illustrate the alloys, articles, and processes of the present disclosure. The examples are merely illustrative and are not intended to limit the disclosure to the materials, conditions, or process parameters set forth therein.

EXAMPLES 1-29

Twenty-nine (29) different compositions were made according to the process described below.

A 22 pound (10 kg) charge of nickel pellets, metallic lump beryllium, and a master alloy of 60% niobium—40% nickel master alloy were weighed out according to the desired mixture of elements. Finely crushed chromium metal was added to the charge, as indicated depending on the example.

The nickel pellets were charged into a 40 pound capacity crucible and heated for about 20 minutes within a 100 kW induction furnace to melt the nickel charge. Melting was conducted under an inert argon cover gas. After the nickel pellets melted, the metallic lump beryllium was added to the melted nickel. The 60% niobium—40% nickel master alloy was added to the nickel/beryllium mixture and stirred with a refractory wand. For the examples that included chromium, the chromium was added after the nickel melted and before the beryllium was added. The melt was then heated over 2 minutes to a pouring temperature of about 2600° F.-2700° F., and immediately poured into a sprue-cup and down through a sprue into a 1"×3"×8" graphite mold.

The mixture solidified in the mold within a few minutes, the mold was removed, and the ingots were air cooled overnight. The 1"×3"×8" ingots were sampled for chemistry verification by inductively coupled plasma and optical emission spectrometry (IDP-OES) and then cut into coupons for microstructural evaluation, hardness testing, solution annealing, and aging. The solution annealing range was determined to be 1900° F. to 2000° F. The times used were 4 to 24 hours. The coupons were aged as well and the preferred aging temperature range was 950° F. for about 6 hours.

The alloy was tested for hot workability by forming into a 1"×1"×2" block that was placed between platens, compressed and heated to about 1950° F. The block was compressed from 2 inches thickness to about 1 inch. In other words, the alloy was deformed 50% near the solution annealing temperature.

The resulting compressed block was analyzed to identify gross cracking, shear instability on a microstructure level, and the level of workability of the alloy. Shear instability is a microstructural phenomenon and is a determination of whether the alloy crystal structure breaks, moves or becomes dislocated. The block was also analyzed to determine if grain boundary precipitate was present.

Tables 1A and 1B present the results of Examples 1-29. Table 1A presents information by weight percent, while Table 1B presents information by mole percentage.

The alloys tested included various elements having ranges of about 0.46% to about 5.62% by weight niobium (Nb), from about 1.68% to about 3.07% beryllium (Be), from about 0% to about 10.4% by weight chromium (Cr), from about 0% to about 0.62% titanium (Ti), and the remaining balance of each alloy included nickel (Ni). The aimed-for chemistry as well as the actually obtained chemistry of each example is listed.

The "Other" column lists the amount of some other measured elements. The Rockwell C hardness (Rc) was measured. Also included are descriptions of the stability of each example after the compression testing for hot workability, and an evaluation of the microstructure.

Example 1 is a conventional alloy containing nickel (Ni), beryllium (Be), and titanium (Ti), corresponding to the Alloy 360™ material. This alloy could not achieve an Rc value of 50.

In Examples 2-8, niobium and chromium were added in various amounts. As seen in Examples 3 and 4, alloys containing 10% chromium and 1-5% niobium did not have a hardness above 50 Rc. However, Example 6, containing 5% Cr, could obtain a hardness of 50 Rc. It thus appeared that lower amounts of Cr increased the hardness of the alloys. In Examples 5, 6, and 8, chromium was considered an impurity. Without being bound, it was theorized that the Nb was consumed or reduced by the Cr.

Figure 3:
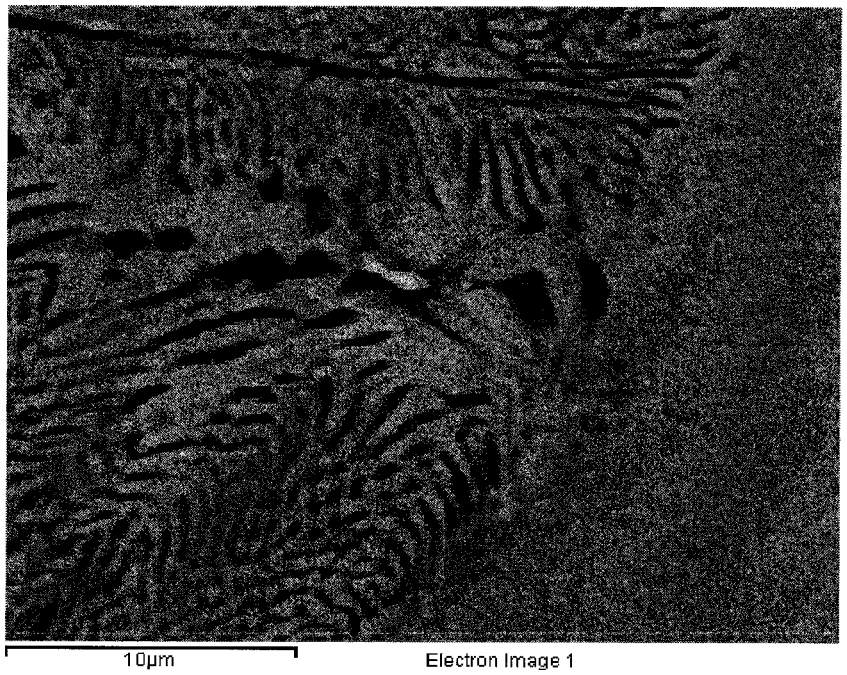
FIG. 3 is an X-ray map of an article formed from an alloy composition of the present disclosure that includes nickel, beryllium, and niobium. This map shows the distribution of elements on the surface of the article.

FIG. 3 is an X-ray map of the Alloy 360X composition of Example 7, comprising about 2.06% Be, 5.62% Nb, and 0.02% Cr with the addition of about 0.62% Titanium (Ti) while the remaining balance is Ni. The Nb and the Ni work together to modify the as-cast structure. This figure exhibits discontinuous features that are characteristic of complex metallurgical systems.

Figure 4:
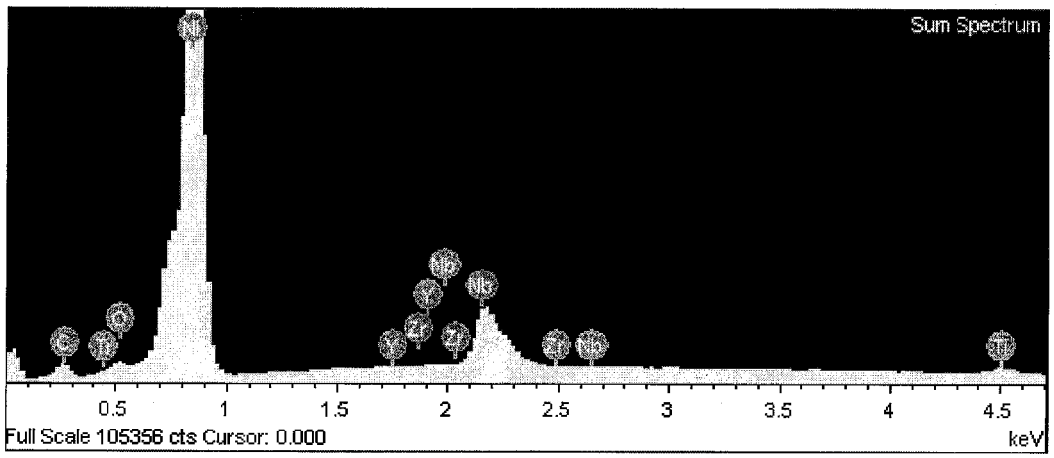
FIG. 4 is a summary spectrum graph that identifies the elemental distribution of the alloy of FIG. 3.

FIG. 4 is a summary spectrum graph that identifies the element distribution of the Alloy 360X composition of FIG. 3. One observation that can be detected from the spectrum graph is that a Y peak and the Zr peak are spurious. The Zr appears more prominent as it begins to overlap with Nb. It is noted that amounts of Be below 8% could not be detected by the spectrometer being used; this is a common problem.

About 0.5% of titanium was included to react with impurities (other small amounts of elements) and render them inert. However, Ti—Ni mixtures tend to have a low melting temperature eutectic point. Based on Examples 2-8, it was decided that titanium would not be added to the remaining examples.

In Examples 9 and 10, the effect of the Be and Nb were separately determined. No Cr or Ti was used. As seen in Example 9, the presence of only Ni and Be was not sufficient to produce a hardness of over 50 Rc. However, the addition of Nb to the alloy to Example 10 increased the hardness to over 50 Rc. It is believed that the addition of Nb changed the grain structure of the alloy to be finer and thereby improved the hot workability of the alloy.

Figure 2:
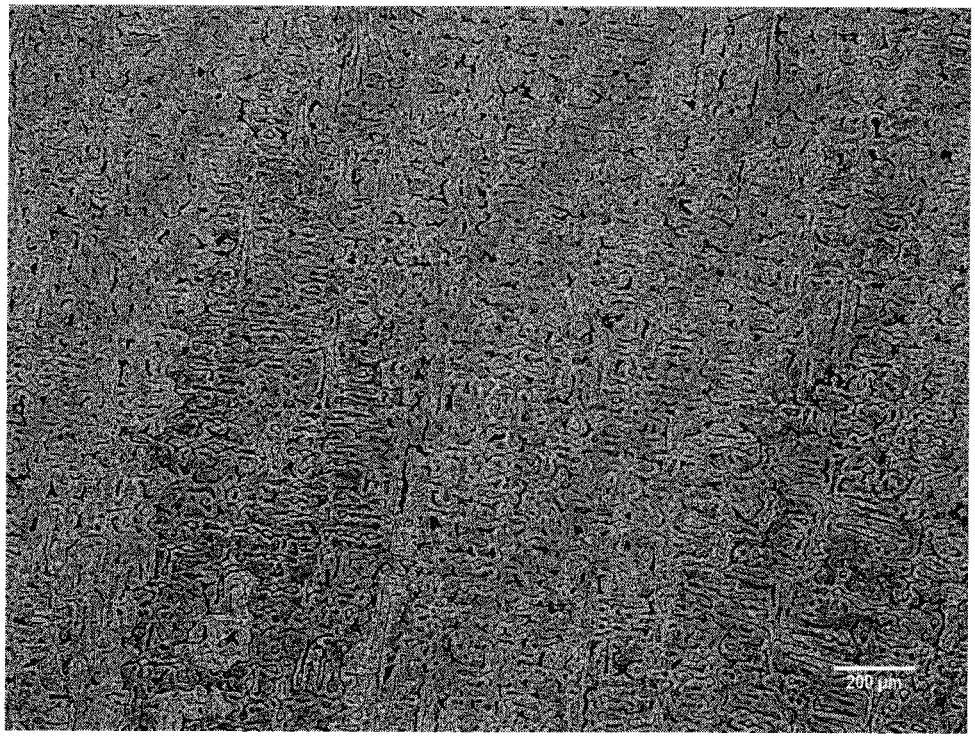
FIG. 2 is a photomicrograph which illustrates an as-cast micro-chemical structure of one embodiment of the present disclosure, wherein the alloy composition includes nickel, beryllium, and niobium.

FIG. 1 is a photomicrograph that illustrates the grain structure of the alloy of Example 9 that includes nickel and beryllium, but does not include niobium. FIG. 2 is a photomicrograph which illustrates the Alloy 360X composition of Example 10, having a combination of nickel, beryllium, and niobium. Both are taken at the same magnification. The grain structure of FIG. 1 is relatively coarse, while the grains in FIG. 2 are much finer.

In Examples 12-24, the relative amounts of Ni, Be, and Nb were varied to determine their effect on the hardness level of the alloy, the stability under 50 compression at 1950° F., and the quality of the microstructure. The column titled "Stable?" indicates whether any gross visual defects were noted. The column titled "Microstructure" indicates whether any microstructural cracks were noted, and also indicates the presence of grain boundary precipitate, abbreviated as "gb ppt". In the "Other" column, the amounts of C, Cu, and Cr are reported. They were reported out to three decimal places in percentage by weight. If the amount was less than 0.001 wt %, then the amount was reported in parts per million (ppm). The aimed-for amount of Be was varied between 2-3 wt %, and the aimed-for amount of Nb was varied between 0.5-5 wt %, with the balance being nickel. No Cr or Ti was added.

Examples 15, 21, and 22 each had over 5 wt % Nb, and two of these three examples did not achieve a hardness of Rc 50. Examples 12-14, 16, 17, and 24 achieved a hardness of at least Rc 52.

Based on those results, additional Examples 25-29 were prepared. These examples contained a narrower aimed-for range of 2.2-2.9 wt % Be and 0.5-1.6 wt % Nb, with the balance being nickel. These examples obtained ranges of 2.2-2.7 wt % Be and 0.4-1.7 wt % Nb. Each of these experiments obtained a hardness factor over 52 Rc. Examples 25, 26, and 29 experienced good compression with faint or no grain boundary precipitate. Examples 27 and 28 were observed to have shearing and external cracking, respectively.

The results of testing for hot workability are provided under the "Stable?" column. None of the alloys experienced catastrophic failure. Based upon these results, articles can be formed by the hot working of as-cast rounds.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

TABLE 1A

| | Aimed-For Chemistry | | | | | Actual Chemistry | | | | | | | | | | |
|---|---|---|---|---|---|---|---|---|---|---|---|---|---|---|---|---|
| Ex. | Ni wt % | Be wt % | Nb wt % | Cr wt % | Ti wt % | Ni wt % | Be wt % | Nb wt % | Cr wt % | Ti wt % | Be:Nb wt ratio | Other | >50 Rc? | >52 Rc? | Stable? | Micro structure |
| 1 | 97.48 | 2.00 | 0.00 | 0.00 | 0.52 | 98.32 | 1.68 | 0.00 | 0.00 | 0.49 | — | 0.19 C | N | N | No | |
| 2 | 96.48 | 2.00 | 1.00 | 0.00 | 0.52 | 96.93 | 1.74 | 1.33 | 0.00 | 0.47 | 1.31 | | Y | N | | |
| 3 | 86.48 | 2.00 | 1.00 | 10.00 | 0.52 | 86.69 | 1.83 | 1.08 | 10.40 | 0.49 | 1.69 | | N | N | | |
| 4 | 82.48 | 2.00 | 5.00 | 10.00 | 0.52 | 82.07 | 2.16 | 5.47 | 10.30 | 0.51 | 0.39 | | N | N | | |
| 5 | 96.48 | 2.00 | 1.00 | 0.00 | 0.52 | 96.46 | 2.04 | 1.24 | 0.26 | 0.50 | 1.65 | 0.26 Cr | Y | Y | | |
| 6 | 89.48 | 2.00 | 3.00 | 5.00 | 0.52 | 89.95 | 2.16 | 3.29 | 4.60 | 0.55 | 0.66 | | Y | N | | |
| 7 | 92.48 | 2.00 | 5.00 | 0.00 | 0.52 | 92.30 | 2.06 | 5.62 | 0.02 | 0.62 | 0.37 | | Y | N | | |
| 8 | 96.48 | 2.00 | 1.00 | 0.00 | 0.52 | 96.95 | 1.94 | 1.11 | 0.01 | 0.49 | 1.75 | 0.005 Cr | Y | N | | |
| 9 | 98.00 | 2.00 | 0.00 | 0.00 | 0.00 | 98.14 | 1.86 | 0.00 | 0.00 | 0.00 | — | | N | — | | |
| 10 | 97.00 | 2.00 | 1.00 | 0.00 | 0.00 | 96.91 | 1.98 | 1.11 | 0.00 | 0.00 | 1.78 | | Y | — | | |
| 12 | 94.75 | 2.5 | 2.75 | 0 | 0 | 94.77 | 2.47 | 2.76 | 0 | 0 | 0.89 | Cu 0.74, C 0.071 | Y | Y | Good | no gb ppt |
| 13 | 93.93 | 2.2 | 3.875 | 0 | 0 | 93.56 | 2.25 | 4.19 | 0 | 0 | 0.54 | Cu 0.11, C 0.014 | Y | Y | Good | faint gb ppt |
| 14 | 96.18 | 2.2 | 1.625 | 0 | 0 | 96.21 | 2.19 | 1.6 | 0 | 0 | 1.37 | Cu 0.09, C 0.022 | Y | Y | Good | faint gb ppt |
| 15 | 92.00 | 3 | 5 | 0 | 0 | 91.66 | 3.02 | 5.32 | 0 | 0 | 0.57 | Cu 0.04, C 0.022 | N | N | Good | Cracked |
| 16 | 96.50 | 3 | 0.5 | 0 | 0 | 96.66 | 2.88 | 0.46 | 0 | 0 | 6.26 | Cu 0.03, C 0.038 | Y | Y | Good | no gb ppt |
| 17 | 95.63 | 2.75 | 1.625 | 0 | 0 | 95.56 | 2.72 | 1.72 | 0 | 0 | 1.58 | Cr 0.005, C 0.0040 | Y | Y | Good | gb ppt |
| 18 | 97.50 | 2 | 0.5 | 0 | 0 | 97.52 | 1.96 | 0.52 | 0 | 0 | 3.77 | Cr <0.005, C 50 ppm | Y | N | Good | gb ppt |
| 19 | 94.75 | 2.5 | 2.75 | 0 | 0 | 94.49 | 2.54 | 2.97 | 0 | 0 | 0.86 | Cr 0.007 C 60 ppm | Y | N | Good | |
| 20 | 93.38 | 2.75 | 3.875 | 0 | 0 | 93.72 | 2.46 | 3.82 | 0 | 0 | 0.64 | Cr. 0.015 C 55 ppm | Y | N | Good | no gb ppt |
| 21 | 92.00 | 3 | 5 | 0 | 0 | 91.75 | 3.07 | 5.18 | 0 | 0 | 0.59 | Cr. 0.019 C 55 ppm | Y | N | Good | no gb ppt |
| 22 | 93.00 | 2 | 5 | 0 | 0 | 92.73 | 2.01 | 5.26 | 0 | 0 | 0.38 | Cr 0.0190 C 35 ppm | N | N | Good | no gb ppt |
| 23 | 97.50 | 2 | 0.5 | 0 | 0 | 97.63 | 1.85 | 0.52 | 0 | 0 | 3.56 | C 0.0020 Cr <500 ppm | Y | N | Good | cracked |
| 24 | 94.75 | 2.5 | 2.75 | 0 | 0 | 94.63 | 2.49 | 2.88 | 0 | 0 | 0.86 | C 0.0045 Cr 600 ppm | Y | Y | Good | faint gb ppt |
| 25 | 96.30 | 2.4 | 1.3 | 0 | 0 | 96.17 | 2.45 | 1.38 | 0 | 0 | 1.78 | C: 480 ppm Cu: 800 ppm | Y | Y | Good | faint gb ppt |
| 26 | 96.60 | 2.9 | 0.5 | 0 | 0 | 96.83 | 2.69 | 0.48 | 0 | 0 | 5.60 | C: 70 ppm Cu: 400 ppm | Y | Y | Good | no gb ppt |
| 27 | 96.40 | 2.6 | 1 | 0 | 0 | 96.76 | 2.26 | 0.98 | 0 | 0 | 2.31 | C: 450 ppm Cu: 400 ppm | Y | Y | Borderline Shear | faint gb ppt |
| 28 | 96.00 | 2.7 | 1.3 | 0 | 0 | 95.94 | 2.67 | 1.39 | 0 | 0 | 1.92 | C: 210 ppm Cu: 300 ppm | Y | Y | Worst External cracks | gb ppt |
| 29 | 96.20 | 2.2 | 1.6 | 0 | 0 | 95.97 | 2.36 | 1.67 | 0 | 0 | 1.41 | C: 70 ppm Cu: 100 ppm | Y | Y | Good | no gb ppt |

TABLE 1B

| | Actual Chemistry | | | | | Nb:Cr | Be:Nb | | | | |
|---|---|---|---|---|---|---|---|---|---|---|---|
| Ex. | Ni mol % | Be mol % | Nb mol % | Cr mol % | Ti mol % | mole ratio | mole ratio | >50 Rc? | >52 Rc? | Stable? | Micro structure |
| 1 | 89.5 | 10.0 | 0.0 | 0.0 | 0.5 | — | — | N | N | No | |
| 2 | 88.4 | 10.3 | 0.8 | 0.0 | 0.5 | — | 13.5 | Y | N | | |
| 3 | 77.7 | 10.7 | 0.6 | 10.5 | 0.5 | 0.1 | 17.5 | N | N | | |
| 4 | 73.4 | 12.6 | 3.1 | 10.4 | 0.6 | 0.3 | 4.1 | N | N | | |
| 5 | 86.6 | 11.9 | 0.7 | 0.3 | 0.6 | 2.7 | 17.0 | Y | Y | | |
| 6 | 80.3 | 12.6 | 1.9 | 4.6 | 0.6 | 0.4 | 6.8 | Y | N | | |
| 7 | 83.9 | 12.2 | 3.2 | 0.0 | 0.7 | 157.3 | 3.8 | Y | N | | |
| 8 | 87.4 | 11.4 | 0.6 | 0.0 | 0.5 | 124.2 | 18.0 | Y | N | | |
| 9 | 89.0 | 11.0 | 0.0 | | | — | — | N | — | | |
| 10 | 87.7 | 11.7 | 0.6 | | | — | 18.4 | Y | — | | |
| 12 | 84.2 | 14.3 | 1.5 | | | — | 9.2 | Y | Y | Good | no gb ppt |
| 13 | 84.4 | 13.2 | 2.4 | | | — | 5.5 | Y | Y | Good | faint gb ppt |
| 14 | 86.3 | 12.8 | 0.9 | | | — | 14.1 | Y | Y | Good | faint gb ppt |
| 15 | 79.9 | 17.2 | 2.9 | | | — | 5.9 | N | N | Good | Cracked |
| 16 | 83.5 | 16.2 | 0.3 | | | — | 64.6 | Y | Y | Good | no gb ppt |
| 17 | 83.6 | 15.5 | 1.0 | | | — | 16.3 | Y | Y | Good | gb ppt |
| 18 | 88.2 | 11.5 | 0.3 | | | — | 38.9 | Y | N | Good | gb ppt |

TABLE 1B-continued

| Ex. | Actual Chemistry Ni mol % | Be mol % | Nb mol % | Cr mol % | Ti mol % | Nb:Cr mole ratio | Be:Nb mole ratio | >50 Rc? | >52 Rc? | Stable? | Micro structure |
|---|---|---|---|---|---|---|---|---|---|---|---|
| 19 | 83.7 | 14.7 | 1.7 | | | — | 8.8 | Y | N | Good | |
| 20 | 83.6 | 14.3 | 2.2 | | | — | 6.6 | Y | N | Good | no gb ppt |
| 21 | 79.8 | 17.4 | 2.8 | | | — | 6.1 | Y | N | Good | no gb ppt |
| 22 | 85.0 | 12.0 | 3.0 | | | — | 3.9 | N | N | Good | no gb ppt |
| 23 | 88.7 | 11.0 | 0.3 | | | — | 36.7 | Y | N | Good | cracked |
| 24 | 84.0 | 14.4 | 1.6 | | | — | 8.9 | Y | Y | Good | faint gb ppt |
| 25 | 85.1 | 14.1 | 0.8 | | | — | 18.3 | Y | Y | Good | faint gb ppt |
| 26 | 84.5 | 15.3 | 0.3 | | | — | 57.8 | Y | Y | Good | no gb ppt |
| 27 | 86.3 | 13.1 | 0.6 | | | — | 23.8 | Y | Y | Borderline Shear | faint gb ppt |
| 28 | 84.0 | 15.2 | 0.8 | | | — | 19.8 | Y | Y | Worst External cracks | gb ppt |
| 29 | 85.4 | 13.7 | 0.9 | | | — | 14.6 | Y | Y | Good | no gb ppt |

The invention claimed is:

1. A nickel beryllium alloy composition comprising:
from about 1.5% to about 5.0% by weight of beryllium (Be);
from about 0.4% to about 6.0% by weight of niobium (Nb);
less than 0.3 wt % aluminum (Al);
up to about 5% by weight chromium; and
at least 88 wt % nickel (Ni).

2. The nickel beryllium alloy composition of claim 1, wherein the alloy composition comprises from greater than 0.5 wt % up to about 5% by weight chromium.

3. The nickel beryllium alloy composition of claim 1, further comprising titanium (Ti) in an amount of up to about 0.7% by weight.

4. The nickel beryllium alloy composition of claim 1, having from about 2.0% to about 3.0% by weight of beryllium (Be).

5. The nickel beryllium alloy composition of claim 1, having from about 0.4% to about 5.0% by weight of niobium (Nb).

6. The nickel beryllium alloy composition of claim 1, having:
from about 2.0% to about 3.0% by weight of beryllium (Be);
from about 0.4% to about 5.0% by weight of niobium (Nb);
less than 0.3% by weight aluminum (Al);
chromium (Cr) in an amount of up to about 5% by weight;
titanium (Ti) in an amount of up to about 0.7% by weight; and
at least 88 wt % nickel (Ni).

7. The nickel beryllium alloy composition of claim 1, having at least 93% by weight of nickel (Ni).

8. The nickel beryllium alloy composition of claim 1, wherein the alloy contains titanium (Ti) as an unavoidable impurity.

9. The nickel beryllium alloy composition of claim 1, having a Rockwell C hardness of at least 50.

10. The nickel beryllium alloy composition of claim 1, having a Rockwell C hardness of at least 52.

11. The nickel beryllium alloy composition of claim 1, wherein the molar ratio of Be:Nb is from 4:1 to 70:1.

12. The nickel beryllium alloy composition of claim 1, consisting essentially of:
from about 2.2% to about 2.9% by weight of beryllium (Be);
from about 0.4% to about 1.8% by weight of niobium (Nb);
less than 0.3% by weight aluminum (Al)
chromium (Cr) in an amount of up to about 5% by weight;
titanium (Ti) in an amount of up to about 0.7% by weight; and
at least 93% by weight of nickel (Ni).

13. The nickel beryllium alloy composition of claim 1, comprising:
at least 89.95 wt % nickel.

14. The nickel beryllium alloy composition of claim 1, comprising:
at least 92.30 wt % nickel.

15. The nickel beryllium alloy composition of claim 1, comprising:
at least 91.75 wt % nickel.

16. A nickel beryllium alloy composition comprising:
from about 1.5% to about 5.0% by weight beryllium (Be);
from about 0.4% to about 6.0% by weight niobium (Nb);
from 0% to about 5% by weight chromium (Cr);
from 0% to about 0.7% by weight titanium (Ti);
less than 0.3% by weight carbon (C);
less than 0.3% by weight copper (Cu);
less than 0.3% by weight aluminum (Al);
less than 0.3% by weight iron (Fe); and
at least 88 wt % nickel (Ni).

17. The nickel beryllium alloy composition of claim 16, comprising:
from about 2.0% to about 3.0% by weight beryllium (Be); and
from about 0.4% to about 5.0% by weight niobium (Nb).

18. The nickel beryllium alloy composition of claim 16, comprising:
at least 89.95 wt % nickel.

19. The nickel beryllium alloy composition of claim 16, comprising:
at least 92.30 wt % nickel.

20. The nickel beryllium alloy composition of claim 16, comprising:
at least 91.75 wt % nickel.

* * * * *